US005445248A

United States Patent [19]

Clarke et al.

[11] Patent Number: 5,445,248

[45] Date of Patent: Aug. 29, 1995

[54] EXHAUST BRAKE

[75] Inventors: John M. C. Clarke; Dennis J. Marander, both of Burnaby, Canada

[73] Assignee: Jenara Enterprises Ltd., Surrey, Canada

[21] Appl. No.: 207,828

[22] Filed: Mar. 7, 1994

[51] Int. Cl.[6] ..... F02D 9/06

[52] U.S. Cl. ..... 188/273; 137/312; 251/305; 285/175

[58] Field of Search ..... 188/273, 154; 251/305, 251/308, 306, 307; 137/312; 285/175; 123/323, 321

[56] References Cited

U.S. PATENT DOCUMENTS

| | | | |
|---|---|---|---|
| 868,182 | 10/1907 | Hayden | 251/305 X |
| 1,744,798 | 1/1930 | Price | 251/305 X |
| 2,054,369 | 9/1936 | Francis, Jr. | 251/307 |
| 2,138,098 | 11/1938 | Holmes | 251/305 X |
| 2,381,426 | 8/1945 | Allen et al. . | |
| 2,766,768 | 10/1956 | Brown et al. | 137/312 |
| 2,774,618 | 12/1956 | Alderson . | |
| 3,096,071 | 7/1963 | Fisher | 251/306 |
| 3,147,773 | 9/1964 | Matthews et al. | 251/305 X |
| 3,904,173 | 9/1975 | Naylor | 251/308 X |
| 3,947,073 | 3/1976 | Cattaneo et al. | 188/273 X |
| 4,054,156 | 10/1977 | Benson | 123/323 X |
| 4,054,306 | 10/1977 | Sadoff, Jr. et al. . | |
| 4,067,352 | 1/1978 | Halpine | 137/312 |
| 4,093,046 | 6/1978 | Perr | 188/273 |
| 4,108,199 | 8/1978 | Bonafous | 137/312 |
| 4,111,166 | 9/1978 | Alstrin et al. | 188/273 X |
| 4,327,765 | 5/1982 | Wilson et al. | 137/312 |
| 4,553,775 | 11/1985 | Halling | 285/175 X |
| 4,669,585 | 6/1987 | Harris | 188/273 |
| 4,773,440 | 9/1988 | Yanagawa et al. | 123/323 X |
| 4,846,212 | 7/1989 | Scobie et al. | 137/312 X |
| 5,103,786 | 4/1992 | Suzuki et al. . | |

FOREIGN PATENT DOCUMENTS

| | | | |
|---|---|---|---|
| 3211920 | 10/1983 | Germany | 188/273 |
| 56-528 | 1/1981 | Japan | 188/154 |
| 3-20178 | 1/1991 | Japan | 251/305 |
| 2064730 | 6/1981 | United Kingdom | 137/312 |
| 9200445 | 1/1992 | WIPO | 188/273 |

OTHER PUBLICATIONS

Extarder—Installation Instruction, p. 3.

PacBrake Manufacturing—Exhaust Restricter Installation, p. 13.

PacBrake Manufacturing—New Product Update–Form No. 5020.

PacBrake Manufacturing—New Product Release–Form No. 5031.

PacBrake Manufacturing—Parts Manual–Form No. 1009.

PacBrake Manufacturing—Exhaust Brake Application Information–Form No. 5020.

*Primary Examiner*—Douglas C. Butler

*Attorney, Agent, or Firm*—Ware, Fressola, Van Der Sluys & Adolphson

[57] ABSTRACT

An exhaust brake system is provided with a compact housing having an exhaust gas passage and an nonsymmetrical, rotatable restricter valve member. The restricter valve member includes a shaft with a restricter shield mounted thereon. The restricter valve member is rotatable from an open position with its shield parallel to the exhaust gas flow to a closed position is perpendicular to the exhaust gas flow. The restricter shield is dimensionally sized with reference to the exhaust brake housing so that a gap is formed therebetween when the restricter shield is in its closed position. The nonsymmetrical design of the restricter valve member creates a weathervane effect, so that the restricter valve will always return to the open position, when it is disconnected from the actuator. The compact design allows direct engine or turbocharger mounting using appropriate connectors. A passive sealing system is provided to prevent any escape of exhaust gas from the exhaust brake around the shaft of the restricter valve member.

14 Claims, 3 Drawing Sheets

EXHAUST BRAKE

BACKGROUND OF THE INVENTION

1. Technical field

The present invention relates to exhaust brakes for large-size vehicles such as trucks or buses and, more particularly, to exhaust brakes for diesel powered vehicles.

2. Description of the Prior Art

Exhaust brakes for diesel powered vehicles are well known. A typical exhaust brake is additional to the regular wheel brakes allowing the driver to slow the vehicle, particularly when proceeding down steep inclines. The exhaust brake is typically mounted under the motor vehicle in the exhaust system beyond the outlet of the engine or any optional turbo-charger thereon where it is exposed to road dirt and debris. When activated, the exhaust brake restricts the escape of exhaust gases, whereby back pressure built up on the engine. The momentum of the vehicle drives the engine against the built-up back pressure causing the engine to absorb horsepower which results in reduction of vehicle's speed.

A typical exhaust brake is comprised of a housing, a "butterfly" restricter-valve and a pneumatic actuator. The restricter valve has a pivotally mounted shaft with a shield thereon. The shape of the shield is matched to a nonperpendicular inner cross-section of the housing. Due to the pivotal mounting of the shaft, the shield may rotate between closed and open positions. Typically, the angle of rotation of the shield is less than ninety degrees (90°) and is limited by an adjustable abutment so that, in the closed position, a certain exhaust gas flow is guaranteed thereby limiting the back pressure on the engine.

In order to increase the braking action of the exhaust brake, users often modify the exhaust brake system by readjusting the abutment thereof and increasing the angle of rotation of the shield. However, in doing this, the permitted maximum back pressure against the engine may be exceeded creating the possibility of severe damage to the engine.

Oftentimes, the shield of the typical prior art exhaust brake may touch the housing when in its closed position. During operation, carbon build-up on the shield from the exhaust gases may cause the shield to become stuck in its closed position and thus fail to operate properly.

Another disadvantage of the typical prior art exhaust brake is that the "butterfly" restricter valve member has a symmetrical design whereby, in the event the actuator fails, the restricter valve member tends to remain in the same position as when the actuator failed.

SUMMARY OF THE INVENTION

It is an object of the present invention to provide novel exhaust brake which has restricter shield dimensionally sized with respect to the housing to permit the shield to be closed to a position perpendicular to the exhaust gas flow.

It is also an object to provide such an exhaust brake which reduces the possibility of the restricter valve becoming stuck due to carbon build-up.

Still another object is to provide an exhaust brake in which the housing may be curved to permit compact installation.

An additional object is to provide an exhaust brake which may be fabricated readily and relatively economically and which will enjoy a long life in operation.

It has now been found that the foregoing and related objects of the present invention can be readily attained in an exhaust brake comprising a compact housing and a nonsymmetrical restricter valve, whereby the restricter shield in the closed position is perpendicular to the exhaust gas flow direction. The restricter valve and the housing are dimensionally sized so that a gap is formed therebetween when the shield is in its closed position. This gap determines the maximum back pressure and prevents the shield from becoming stuck on the housing due to carbon build-up from the exhaust gases. Because the closed position of the restricter shield is perpendicular to the exhaust gas flow, any attempted modification by the user will not increase the back pressure.

The nonsymmetrical design of the restricter valve is achieved by an off-center shaft weathervane effect on the restricter shield. Due to this, the restricter valve will return to its open position, if its actuator should fail.

To achieve a compact design, the housing of the exhaust brake of the present invention may be curved. The inlet side of the housing may be fitted with a standard band clamp connector, which allows direct mounting to the engine or turbocharger outlet. The compact design and the possibility of direct engine or turbocharger mounting permits installation of exhaust brake during manufacturing the engine. Direct mounting also reduces all carbon build-up, because the exhaust gases are still extremely hot as they pass through the exhaust brake.

Conveniently, the shape of the outlet side of the exhaust brake housing may partly follow the shape of a sphere providing a positive seal if the exhaust system is misaligned therewith.

Ideally, the exhaust brake of the present invention includes passive sealing system in the housing around the shaft for the restricter valve. The passive sealing system prevents any exhaust gas leakage from around the shaft.

Our invention will be fully understood when reference is made to the following detailed description taken in conjunction with the accompanying drawings.

DETAILED DESCRIPTION OF THE INVENTION

Figure 1:
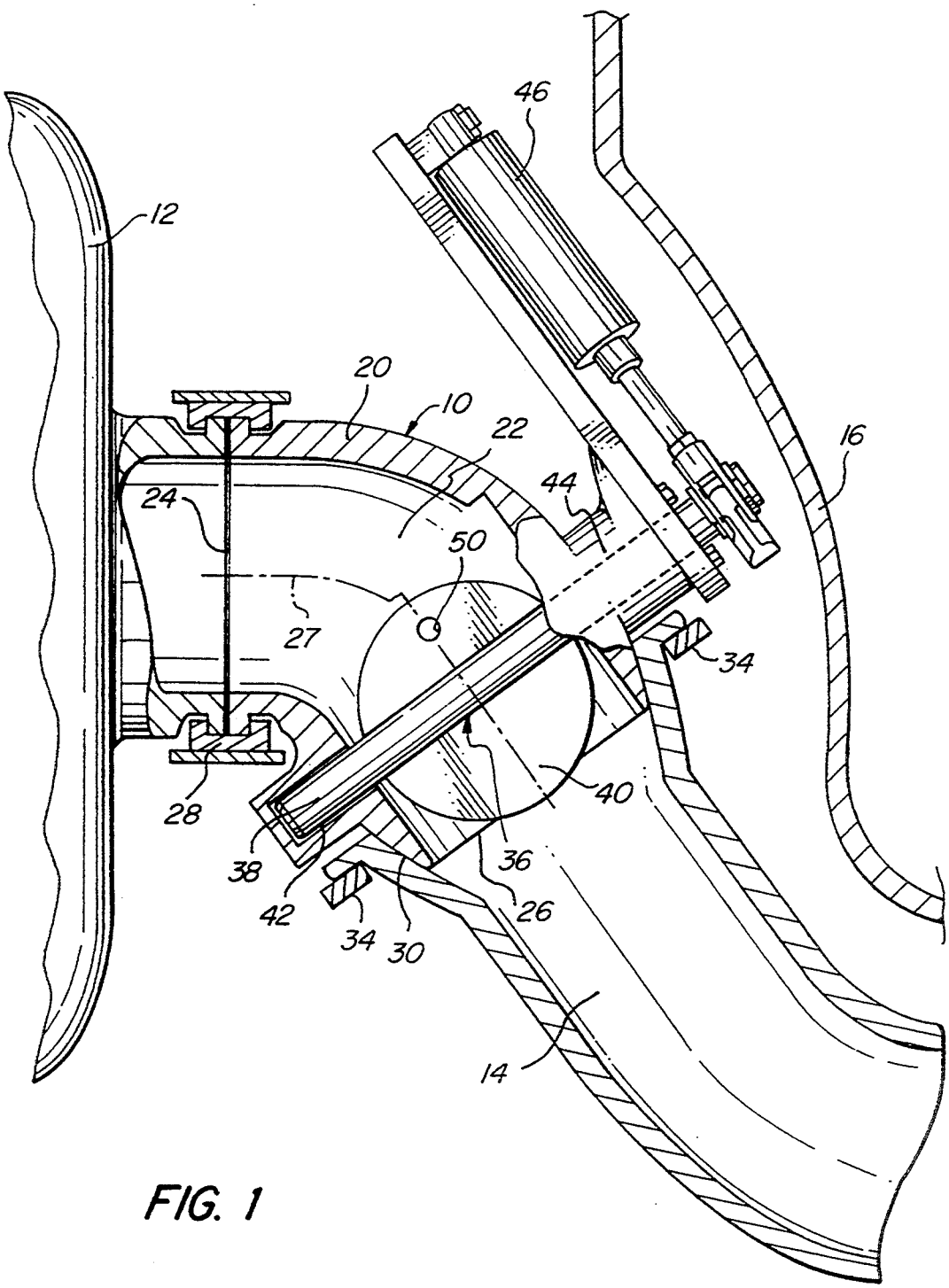
FIG. 1 is a side elevational view of the exhaust brake of the present invention installed in a motor vehicle, with a portion broken away to illustrate internal structure.

Turning first to FIG. 1 of the drawings, therein illustrated is a portion of a diesel powered motor vehicle having an exhaust brake 10 of the present invention installed therein. The exhaust brake 10 is mounted between a turbocharger 12 and exhaust pipe 14 of the diesel powered motor vehicle. The space for an installation of the exhaust brake 10 is limited by a firewall 16 of the motor vehicle.

Figure 2:
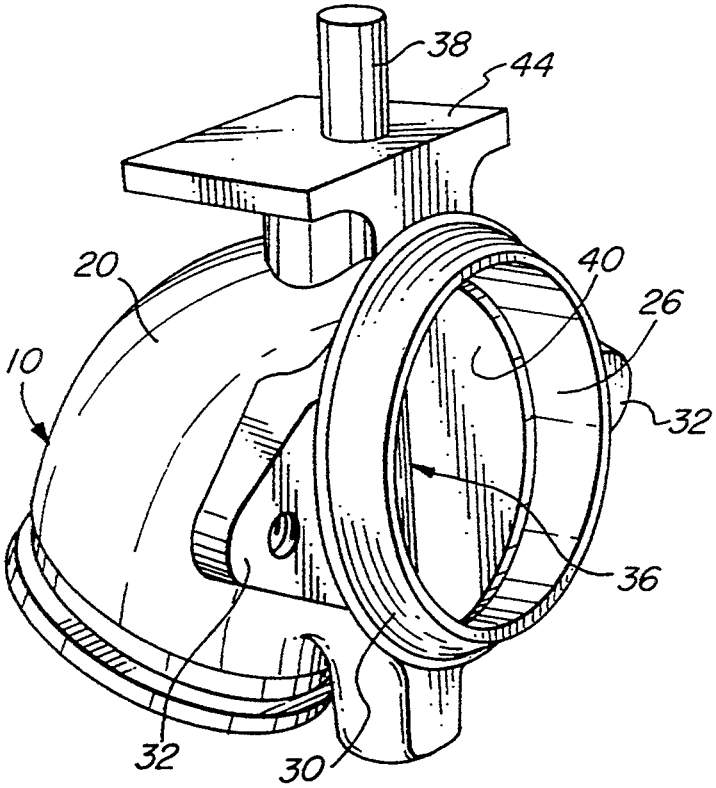
FIG. 2 is a perspective view of the exhaust brake of the present invention without its actuator.

Referring to FIG. 2 in conjunction with FIG. 1, the exhaust brake 10 has a housing 20, forming an exhaust gas passage 22, at least a portion of which is curved, with orifices 24 and 26 at either end thereof and a centerline 27. In the area of the orifice 24 serving as inlet for the exhaust gas passage 22, the housing 20 is dimensionally shaped to accept to a standard band clamp 28, permitting installation of the exhaust brake 10 directly to an outlet of the turbocharger 12. At the outlet side of the exhaust brake 10, the housing 20 has an abutment surface 30 dimensionally shaped to form a portion of a sphere so that the exhaust pipe 14 may be mounted therewith at a range of angles to the exhaust brake 10 without losing a positive seal therewith. To fasten the exhaust pipe 14 to the housing 20 of the exhaust brake 10, a pair of ear members 32 (FIG. 2) are provided on the housing 20. Each ear has a boring with a thread designed to accept a bolt (not shown) which extends through a ring 34 (FIG. 1) with similar ears to hold the housing 20 and exhaust pipe 14 in assembly as is well known to those skilled in the art.

To control the exhaust gas flow, the exhaust brake 10 has a restricter valve member, generally shown by the numeral 36, which comprises a shaft 38 with a restricter shield 40 thereon. To mount the restricter shield 40 to the shaft 38, the shaft 38 has a longitudinal slit into which the restricter shield 40 is radially positioned. Thereafter, the shaft 38 and the restricter shield 40 are welded together.

Figure 3:
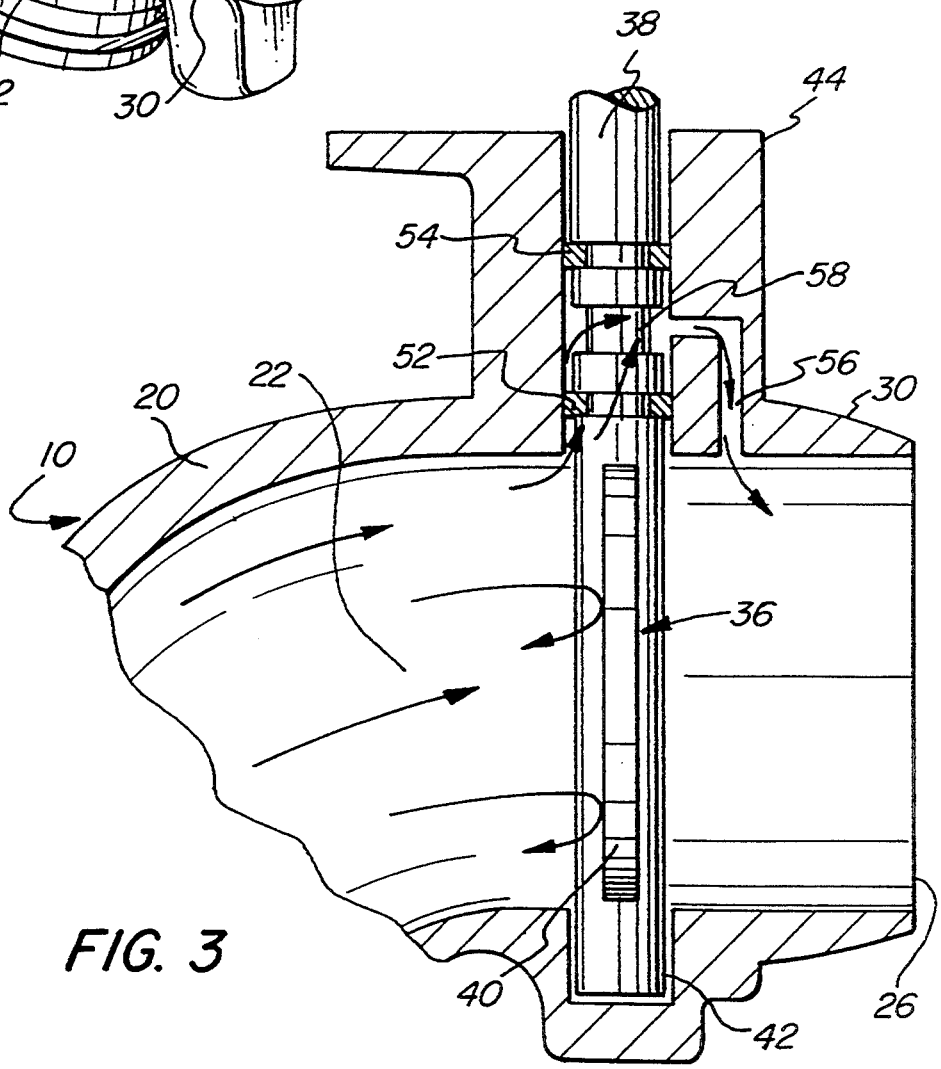
FIG. 3 is a detailed cross-sectional view of the exhaust brake showing the passive sealing system.
Figure 5A:
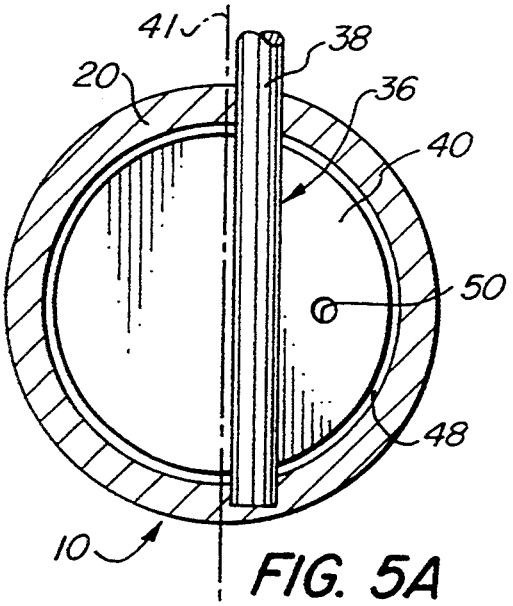
FIG. 5A is a diagrammatical cross-sectional view similar to FIG. 4A but with the exhaust brake in its closed position.
Figure 4A:
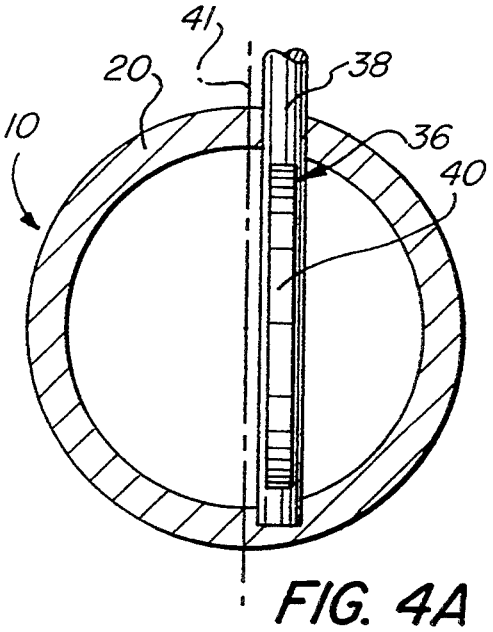
FIG. 4A is a diagrammatical cross-sectional view taken along a plane perpendicular to the axis of the housing and showing the exhaust brake in its open position.
Figure 5B:
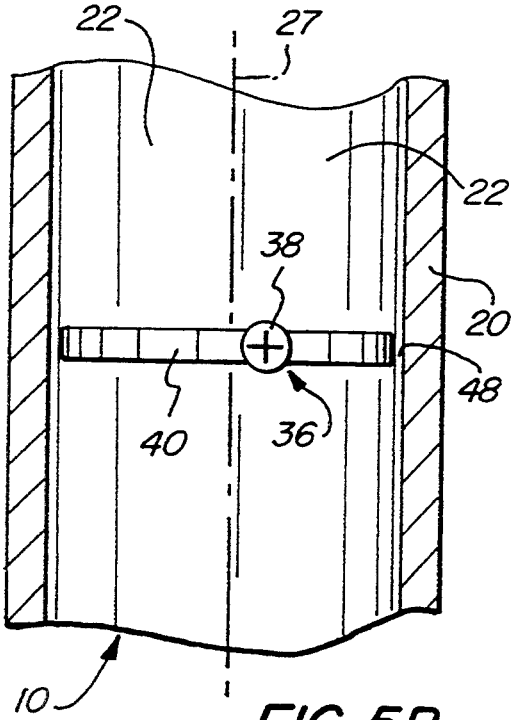
FIG. 5B is a diagrammatical cross-sectional view similar to FIG. 4B but with the exhaust brake in its closed position.
Figure 4B:
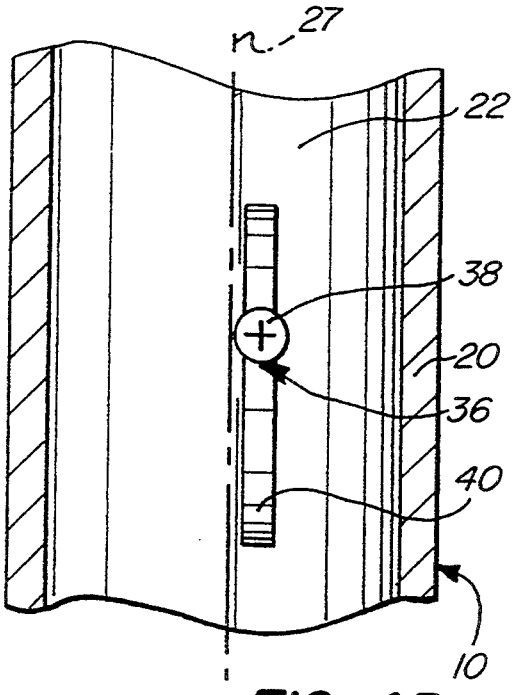
FIG. 4B is a diagrammatical cross-sectional view taken along a plane parallel to the axis of the housing and showing the exhaust brake in its open position.

The shaft 38 extends across the exhaust gas passage 22 offset from a radial axis 41 thereof (see FIGS. 4A and 5A). The shaft 38 is seated in a journal bearing 42 in the housing 20 and extends with its other end through an enlarged protuberance 44 on the housing 20. The restricter valve member 36 is rotatable between an open position (FIGS. 1, 2, 4A and 4B) and a closed position (FIGS. 3, 5A and 5B) by means of a pneumatic actuator 46 which is mounted on the enlarged protuberance 44 as shown in FIG. 1. In a manner well know to those skilled in the art, the actuator 46 is secured to the free end of the shaft 38 extending from the enlarged protuberance 44 and can be actuated by the driver of the vehicle via a control knob (not shown) located in the cab of the vehicle. The restricter shield 40 and the exhaust gas passage 22 of the housing 20 are dimensionally sized so that a gap 48 is formed therebetween, when the restricter valve member 36 is in its closed position. The restricter shield 38 is also provided with a hole 50 therein.

To prevent any exhaust gas leakage from the housing 20 around the shaft 38, a passive sealing system, as shown in FIG. 3, is provided. The passive sealing system comprises two seal rings 52 and 54, a bypass port 56 in the housing 20 and a bypass groove 58 on the shaft 38. When the restricter shield 40 is in its closed position, a high exhaust gas pressure builds up at the inlet side of the exhaust brake 10, whereas the exhaust gas pressure at the outlet side of the exhaust brake 10 remains low. If a traditional shaft sealing method is used, some exhaust gas could escape from the high pressure inside of the housing 20 to the atmosphere through the shaft bearing. To prevent this in the present invention, the bypass port 56 and the bypass groove 58 are provided. Due to the bypass port 56 in the housing 20, the exhaust gas pressure in the bypass groove 58 is essentially at the same low pressure as in the outlet of the exhaust brake 10. Because of this, the difference in the gas pressure between both sides of the seal ring 54 will remain small and any exhaust gas passing the seal ring 52 will not pass the second seal ring 54, but will be directed through the bypass port 56.

Referring to the FIGS. 4A to 5B, the operation of the exhaust brake may easily be understood. Under normal driving conditions, the restricter valve member 36 is in its open position shown in FIG. 4A and 4B with the major surfaces of the restricter shield 40 parallel to the centerline 27, thereby creating only minimal resistance to the passage of the exhaust gas. However, when the vehicle is going down an incline where braking is desired, the operator will apply the exhaust brake 10 by engaging the actuator control knob (not shown) in the cab of the vehicle. This causes the actuator 46 to rotate the restricter valve member 36 to its closed position shown in FIGS. 5A and 5B. In the closed position, the restricter shield 40 has its major surfaces perpendicular to the centerline 27, causing a maximum obstruction to the flow of the exhaust gas and therefore maximum back pressure. The maximum back pressure is determined by the dimension of the gap 48 around the restricter shield 40 and the optional hole 50 in the restricter shield 40. Therefore, unlike the prior art devices, it is not possible in the exhaust brake 10 of the present invention for the operator to increase the maximum back pressure by manipulating the angle of rotation of the restricter valve member 36 and exceeding the maximum permitted back pressure allowed on the engine. Furthermore, because of the gap 48, the restricter shield 40 will never touch the housing 20 of the exhaust brake 10, whereby it cannot become stuck on the housing 20 due to carbon build-up from the exhaust gases.

Additionally, the nonsymmetrical design of the restricter valve member 36 with the restricter shield 40 mounted off-center on the shaft 38 produces a weathervane effect when the exhaust gases encounter the two portions of different areas on the restricter shield 40. This weathervane effect will return the restricter valve member 36 to its open position in the event of a failure of the actuator 46 as the forces exerted by the flowing exhaust gases on one side of the restricter shield 40 are greater than on the other side thereof.

The compact, curved design of the housing 20 allows installation of the exhaust brake 10 even in tight locations directly in front of the fire wall 16. Unlike the prior art devices which are sometimes installed well downstream of the engine or turbocharger, an installation of the exhaust brake 10 directly at the outlet of the engine or the turbocharger 12 provides a constant stream of hot exhaust gases, thereby preventing carbon build up on the restricter shield 40 and thus eliminating one of the main reasons for exhaust brake failure. Furthermore, the direct mounting allows the exhaust brake to be mounted inside the engine compartment away from the harmful effects of road dirt and debris. As another advantage of the direct mounting, the exhaust brake 10 can be installed at the factory by the engine manufacturers allowing the engine to be shipped with the exhaust brake as a complete package.

It will be appreciated that the described exhaust brake provides a simple and effective device for braking a diesel powered motor vehicle and avoids all the previously mentioned disadvantages found in the prior art.

The preferred embodiment described above admirably achieves the objects of the invention. However, it will appreciated that departures can be made by those skilled in the art without departing from the spirit and scope of the invention which is limited only by the following claims.

What is claimed is:

1. An exhaust brake system for use with a diesel powered engine having an exhaust system for directing a flow of exhaust gases, comprising:

a housing with a curved exhaust gas passage therein and connectors at either end thereof, said housing having an aperture therein, said curved exhaust gas passage having a centerline;

a restricter valve member mounted for rotation within said housing between closed and open positions, said restricter valve member including a rotatable shaft extending through said aperture of said housing and across said curved exhaust gas passage of said housing, a restricter shield mounted on said rotatable shaft, said restricter shield having at least one major surface which is positioned perpendicular to said centerline of said curved exhaust gas passage for restricting the flow of exhaust gases when said restricter valve member is in its closed position, said restricter shield in the open position of said restricter valve member has its at least one major surface positioned parallel to said centerline so as to only minimally impede the flow of exhaust gases, said restricter shield is dimensionally sized with respect to said curved exhaust gas passage of said housing so that a gap is formed between said restricter shield and said housing when said restricter valve member is in its closed position;

an actuator for moving said restricter valve member between its closed and open positions; and passive sealing means between said restricting means and said housing to prevent leakage of exhaust gases from said housing, said passive sealing means having at least one seal ring surrounding said rotatable shaft to prevent leakage of exhaust gases from said housing, said housing having a bypass port from said aperture to said exhaust gas passage downstream of said aperture, whereby exhaust gases are directed through said bypass port back to said exhaust gas passage from said aperture.

2. An exhaust brake system in accordance with claim 1, wherein said centerline of said exhaust gas passage is curved.

3. An exhaust brake system in accordance with claim 2, wherein said housing has a curved profile.

4. An exhaust brake system in accordance with claim 1, wherein said housing has a curved profile.

5. An exhaust brake system in accordance with claim 1, wherein one of said connectors on said housing includes ear means having threaded apertures for securing said housing to the exhaust system.

6. An exhaust brake system in accordance with claim 1, wherein one of said connectors on said housing is shaped to form part of a sphere so that the exhaust system can be connected thereto at a variety of angles.

7. An exhaust brake system in accordance with claim 1, wherein said restricter valve member is nonsymmetrical.

8. An exhaust brake system in accordance with claim 7, wherein said rotatable shaft extending through said aperture of said housing and across said curved exhaust gas passage of said housing is offset from said centerline thereof.

9. An exhaust brake system in accordance with claim 8, wherein said restricter shield is mounted on said rotatable shaft so that an area of said restricter shield on one side of said rotatable shaft is greater than an area on the other side of said rotatable shaft.

10. An exhaust brake system in accordance with claim 9, wherein said at least one seal ring is first and second seal rings in said aperture.

11. An exhaust brake system in accordance with claim 1, wherein said restricter valve member is nonsymmetrical.

12. An exhaust brake system in accordance with claim 1, wherein said rotatable shaft extending through said aperture of said housing and across said curved exhaust gas passage of said housing is offset from said centerline thereof.

13. An exhaust brake system in accordance with claim 1, wherein said restricter shield is mounted on said rotatable shaft so that an area of said restricter shield on one side of said rotatable shaft is greater than an area on the other side of said rotatable shaft.

14. An exhaust brake system in accordance with claim 1, wherein said at least one seal ring is first and second seal rings in said aperture.

* * * * *